US011648487B2

(12) United States Patent
Bradley et al.

(10) Patent No.: US 11,648,487 B2
(45) Date of Patent: May 16, 2023

(54) WEARABLE INFLATABLE HEADPIECE WITH AUTOMATED SOAP BUBBLE PRODUCTION MECHANISM

(71) Applicants: Patricia Allison Bradley, Fletcher, NC (US); Michelle Shiovaun Mullen, Fletcher, NC (US)

(72) Inventors: Patricia Allison Bradley, Fletcher, NC (US); Michelle Shiovaun Mullen, Fletcher, NC (US)

( * ) Notice: Subject to any disclaimer, the term of this patent is extended or adjusted under 35 U.S.C. 154(b) by 0 days.

(21) Appl. No.: 17/408,413

(22) Filed: Aug. 21, 2021

(65) Prior Publication Data

US 2022/0054951 A1 Feb. 24, 2022

Related U.S. Application Data

(60) Provisional application No. 63/068,979, filed on Aug. 21, 2020.

(51) Int. Cl.
*A42B 1/004* (2021.01)
*A63H 33/28* (2006.01)

(52) U.S. Cl.
CPC ..... *A63H 33/28* (2013.01); *A42B 1/004* (2013.01)

(58) Field of Classification Search
CPC ..... A63H 33/28; A42B 1/004
USPC ..... D21/401–402; 446/220–226
See application file for complete search history.

(56) References Cited

U.S. PATENT DOCUMENTS 1,021,323 A * 3/1912 McMurty ..... A42B 1/24 2/209.13
2,654,973 A * 10/1953 Lemelson ..... A63H 33/40 D2/866
3,775,899 A * 12/1973 Wolf ..... A63H 33/28 446/17
3,848,355 A * 11/1974 Weight ..... A63H 33/28 446/17
4,257,185 A * 3/1981 Tomson ..... A63H 33/28 446/16
D292,641 S * 11/1987 Jernander ..... D2/866
4,787,875 A * 11/1988 Baron ..... A63H 33/28 239/289

(Continued)

OTHER PUBLICATIONS

Party in a Box, Bubble Hat, Feb. 20, 2015, YouTube video (https://www.youtube.com/watch?v=JV59WL-teqM), 2 screenshots.*

*Primary Examiner* — Eugene L Kim
*Assistant Examiner* — Matthew B Stanczak
(74) *Attorney, Agent, or Firm* — Joseph T. Guy; Patent Filing Specialist Inc.

(57) ABSTRACT

An automatic bubble blowing apparatus wearable on the head and having an inflatable ornamental skin. The inflatable ornamental skin is a non-tooled component which can be manufactured to have a variety of festive appearances. The apparatus has straps which can be used to secure the apparatus to the head of a user. Alternatively, the automatic bubble blowing apparatus can be utilized on a horizontal surface, such as a table, with the straps hidden under the apparatus. The automatic bubble blowing apparatus includes a power source, a surfactant solution reservoir, a fan for creating an air stream out an exit aperture, a mechanism for creating a surfactant film across the exit aperture, and an on-off switch which controls both power to the fan and sealing and unsealing of the exit aperture.

8 Claims, 10 Drawing Sheets

(56) References Cited

U.S. PATENT DOCUMENTS 5,080,623 A * 1/1992 Stein ..... A63H 33/28
D21/402
5,238,437 A * 8/1993 Vowles ..... A63H 3/003
446/268
5,243,707 A * 9/1993 Bodinet ..... A42B 1/203
2/200.1
5,263,714 A * 11/1993 Rudell ..... A63F 9/00
446/176
5,708,983 A * 1/1998 Cross ..... A42B 1/201
2/200.2
5,890,942 A * 4/1999 Souza-Ferreira ..... A63H 33/28
446/268
5,970,523 A * 10/1999 Atkins ..... A42B 1/24
2/209.13
5,984,758 A * 11/1999 Driska ..... A63H 33/30
446/143
6,241,571 B1 * 6/2001 Chow ..... A63H 33/28
446/16
6,389,604 B1 * 5/2002 Day ..... A42B 1/203
2/200.1
6,905,388 B2 * 6/2005 Schoonmaker ..... A63H 23/10
446/156
8,266,828 B2 * 9/2012 Strong ..... A43B 23/24
446/221
D716,381 S * 10/2014 Lo ..... D21/599
9,022,614 B2 * 5/2015 Chin-Huan ..... F21V 3/026
362/307
D751,150 S * 3/2016 Chen ..... D21/401
D807,965 S * 1/2018 Lo ..... D21/597
10,105,618 B2 * 10/2018 Fu ..... A63H 37/00
D871,508 S * 12/2019 Lo ..... D21/483
D900,941 S * 11/2020 Wang ..... D21/401
2016/0206969 A1 * 7/2016 Kyono ..... G06F 3/167
2018/0304168 A1 * 10/2018 Baranoff ..... A63H 33/28
2022/0054951 A1 * 2/2022 Bradley ..... A63H 33/28

* cited by examiner

WEARABLE INFLATABLE HEADPIECE WITH AUTOMATED SOAP BUBBLE PRODUCTION MECHANISM

RELATED APPLICATIONS

The present application is based on and claims priority to provisional patent application Ser. No. 63/068,979 filed Aug. 21, 2020 by the same inventors and having the title "Wearable headpiece with automated soap bubble producer."

FIELD OF THE INVENTION

The present invention relates to party clothes and costumes and festivity accoutrements, and particularly to head adornments and party hats. The present invention also relates to bubble blowing toys and inflatables.

BACKGROUND OF THE INVENTION

There is an extremely wide variety of party clothes, party costumes, festivity and entertainment accoutrements, etc. available on the market, including a wide variety of party hats. Some such clothes and accoutrements are made for particular types of parties and celebrations and some are more generic. Furthermore, a wide variety of bubble blowing toys and devices have been developed and marketed. However, it is believed that never before has a wearable inflatable headpiece with a soap bubble production mechanism, and particularly an automated soap bubble production mechanism, been developed. Furthermore, it is believed that never before has such a wearable headpiece been developed where the headpiece has an inflatable character or themed component which presents the playful or festive appearance. The development of such has involved surmounting various design challenges as will be described or suggested below.

It is therefore an object of the present invention to provide a wearable inflatable headpiece with a soap bubble production mechanism.

More particularly, it is therefore an object of the present invention to provide a wearable inflatable headpiece with an automated soap bubble production mechanism.

Furthermore, it is an object of the present invention to provide a wearable inflatable headpiece with a soap bubble production mechanism which incorporates character and festive themed inflatable components.

Furthermore, it is an object of the present invention to provide a wearable inflatable headpiece with a soap bubble production mechanism which incorporates a non-tooled decorative component.

Furthermore, it is therefore an object of the present invention to provide a soap bubble production mechanism which allows for hands-free production of soap bubbles.

Furthermore, it is therefore an object of the present invention to provide a wearable inflatable headpiece with a soap bubble production mechanism which is easy to wear.

It is another object of the present invention to provide a wearable inflatable headpiece with a soap bubble production mechanism which is easy to operate.

It is another object of the present invention to provide an armature for a wearable headpiece with a soap bubble production mechanism which may seat a variety of decorative "skins."

More particularly, it is an object of the present invention to provide an armature for a wearable headpiece with a soap bubble production mechanism which may seat a variety of decorative, inflatable skins.

It is another object of the present invention to provide an armature for a wearable inflatable headpiece with a soap bubble production mechanism which minimizes or prevents spillage of bubble solution.

Additional objects and advantages of the invention will be set forth in the description which follows, and will be obvious from the description or may be learned by practice of the invention. The objects and advantages of the invention may be realized and obtained by means of the instrumentalities and combinations particularly pointed out in the claims.

SUMMARY OF THE INVENTION

A wearable inflatable amusement apparatus having an automatic bubble blowing apparatus, a chassis worn on the head of a wearer, the chassis seating the automatic bubble blowing apparatus, straps for attachment of the chassis of the head of the wearer; and an ornamental skin mounted on said chassis. The bubble blowing apparatus includes a power source, a surfactant solution reservoir, a fan for creating an air stream, and a mechanism for repeatedly creating a surfactant film in the path of the air stream.

BRIEF DESCRIPTION OF THE DRAWINGS

The accompanying figures, which are incorporated in and form a part of this specification, illustrate embodiments of the invention and, together with the description given above and the detailed description of the preferred embodiments given below, serve to explain the principles of the invention.

DETAILED DESCRIPTION OF THE PREFERRED EMBODIMENTS

Figure 1A:
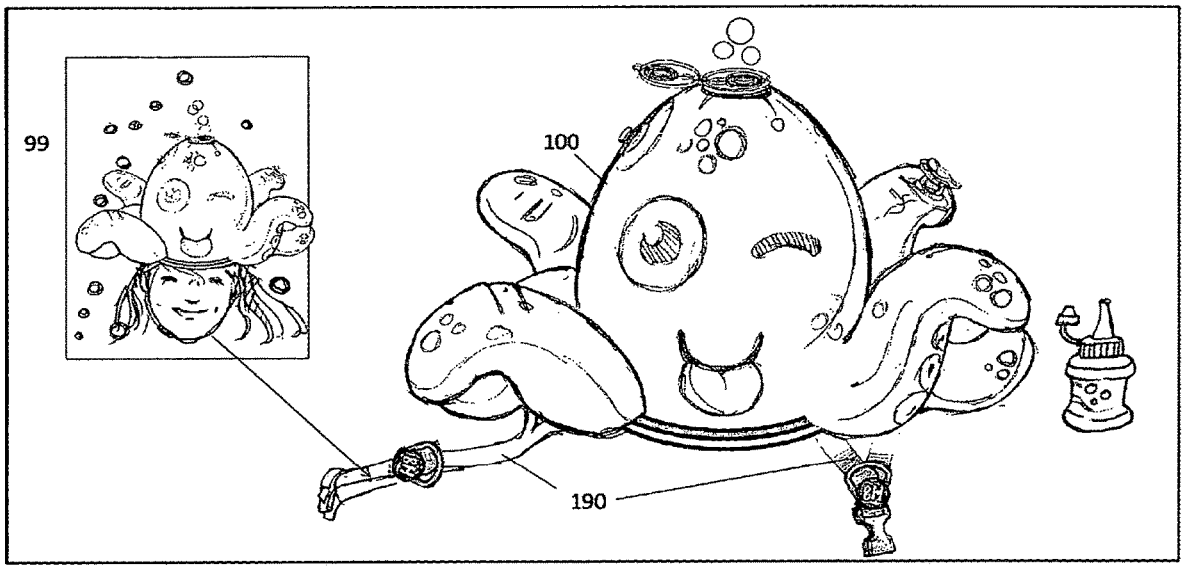
FIG. 1A shows a wearable inflatable headpiece with a soap bubble production mechanism according to the present invention, the headpiece having a skin of a cartoon octopus and being worn as a headpiece.
Figure 1B:
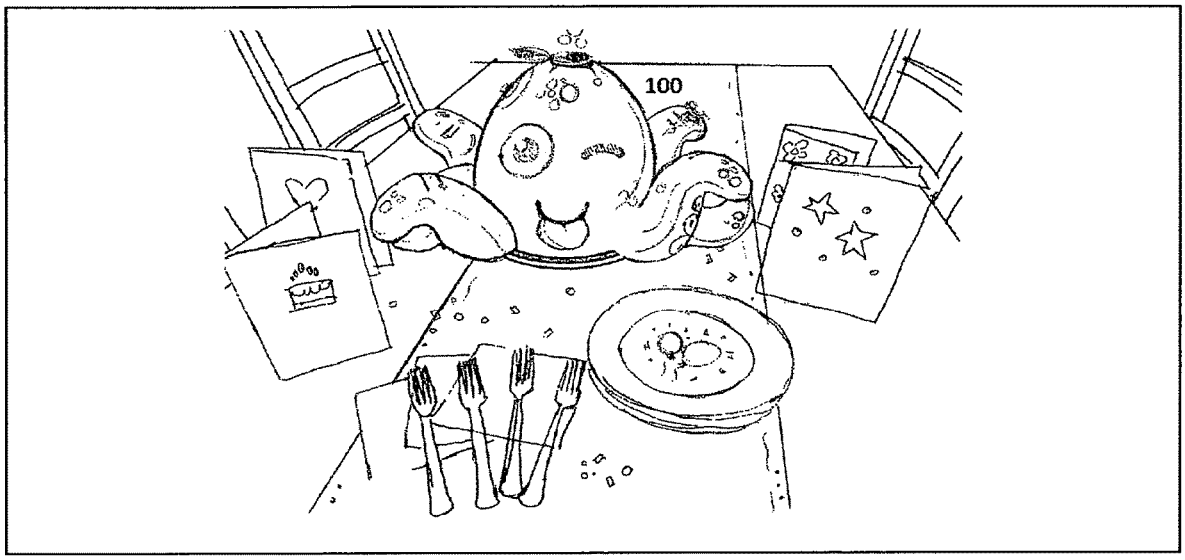
FIG. 1B shows a wearable inflatable headpiece with a soap bubble production mechanism of FIG. 1A, the headpiece being used as a centerpiece on a table.
Figure 1C:
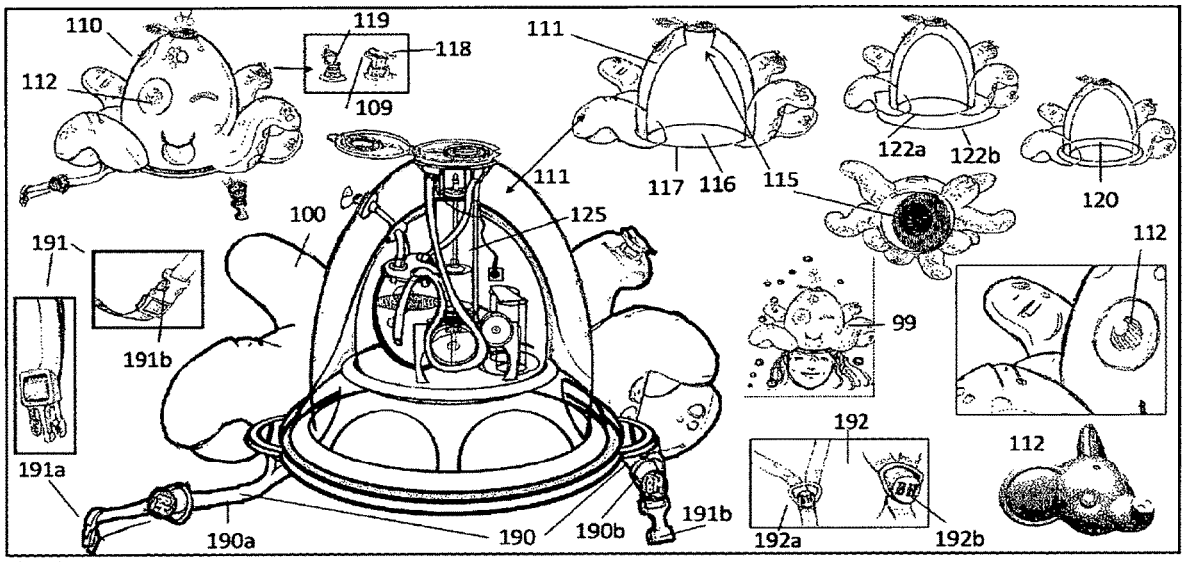
FIG. 1C shows a cut-away view of the wearable inflatable headpiece of FIG. 1A revealing the bubble blowing mechanism and its components.

FIG. 1A shows a wearable inflatable headpiece (100) with a soap bubble production mechanism according to the present invention worn on the head of a wearer (99) in perspective view. FIG. 1B shows the wearable inflatable headpiece (100) with a soap bubble production mechanism according to the present invention being used as a centerpiece on a table. FIG. 1C shows a cut-away view of the headpiece (100) exposing internal components. The headpiece (100) includes an inflatable ornamental skin (110), which in the particular preferred embodiment depicted is in the form of a cartoon octopus. The ornamental skin (110) is an inflatable bladder (111) made of vinyl or a vinyl-like material, such as nylon, which has an exterior ornamental surface (112) and an inside cavity (115) with access (116) from the bottom surface (117) thereof. Making the inflatable ornamental skin (110) of vinyl provides the advantage that the inflatable ornamental skin (110) is a non-tooled component. This allows inflatable ornamental skin (110) to have a wide variety of appearances to be made relatively inexpensively.

A vent channel (125) runs from the top of the inside cavity (115) to the top of the ornamental skin (110). The headpiece (100) is secured to the wearer (99) by left and right head straps (190*a*) and (190*b*) (referred to generically or collectively with reference numeral "190"), the attachment straps (190*a*) and (190*b*) having male- and female-part removably attachable buckles (191*a*) and (191*b*) at ends of the straps (190) distal from the ends attached to the inflatable ornamental skin (110). The male-part and female-part buckles (191*a*) and (191*b*) are positionable on the straps (190*a*) and (190*b*) via positionable sliding clasps (192*a*) and (192*b*). As shown in FIG. 1A, the straps (190) can be used to secure the headpiece (100) to the head of a wearer (99). And if used while not being worn, such as for a centerpiece on a table as is shown in FIG. 1B, the straps (190) can be tucked under the inflatable headpiece (100) so as not to be visible.

The exterior inflatable ornamental surface (112) will commonly have a festive appearance, such as by having the appearance of a cartoon character or an animal, such as an octopus, elephant, dinosaur, shark, unicorn, or bulldog. Exterior ornamental surfaces (112) may be themed for various holidays, sports teamed, events, regions, etc. Such events may be for children or adults. For instance, the exterior inflatable ornamental surface (112) may have the form of a birthday cake, wedding cake, New Year's tiara, graduation cap, jack-o-lantern, political figure, mascot, etc.

The inflatable bladder (111) has an oral inflation valve (119). The inflatable bladder (111) may be inflatable by air pressure from the mouth applied at the oral inflation valve (119). The oral inflation valve (119) is pluggable with a spigot plug (118) which is attached to the oral inflation valve (119) via a flexible attachment strap (109).

The outside bottom of the inflatable bladder (111) has a pair of lower perimeter downwards slanting flanges (122*a*) and (122*b*) which present the form of a conical section. The upper downwards slanting flange (122*a*) extends from the bottom edge of the exterior ornamental surface (112) and the lower downwards slanting flange (122*b*) extends from the bottom edge of the inside cavity (115). A support ring (120), which may for instance be made of polyvinyl chloride or polypropylene, has an upwards facing top surface which may squarely abut the lower surface of the lower downwards slanting flange (122*b*). The downwards slanting flanges (122*a*) and (122*b*) are bonded via spot or continuous tracking welds using high-frequency welding to the stiff support ring (120). The bonding of the support ring (120) to the upper and lower downwards slanting flanges (122*a*) and (122*b*) (when the oral inflation valve (119) is plugged with the spigot plug (118)), seals the bladder (111) with an air-tight seal.

Figure 2A:
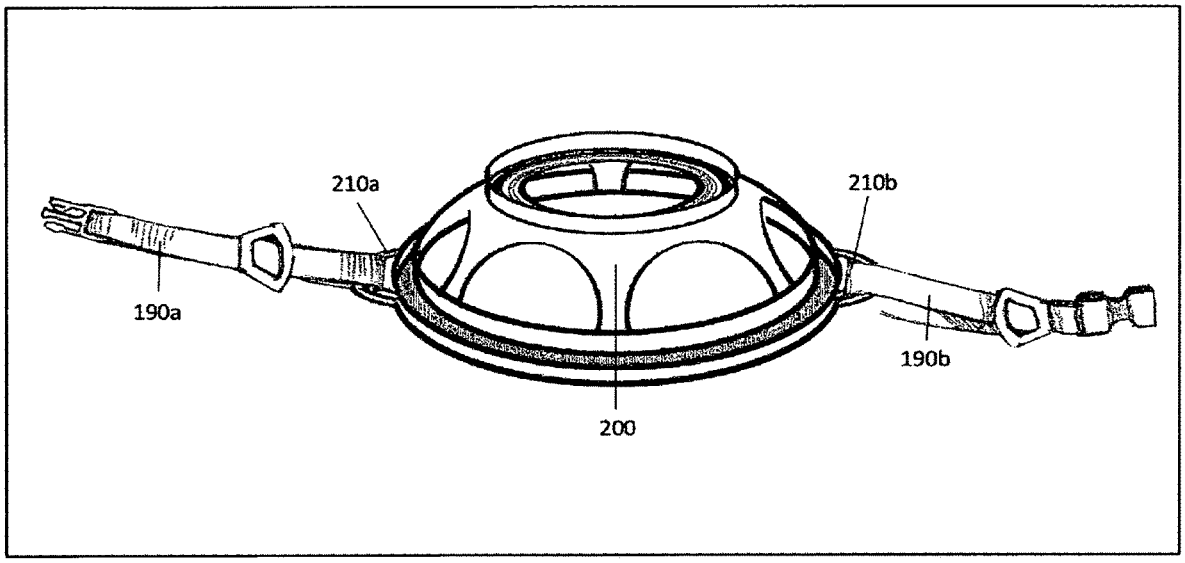
FIG. 2A shows the chassis of the wearable inflatable headpiece in perspective view.
Figure 2B:
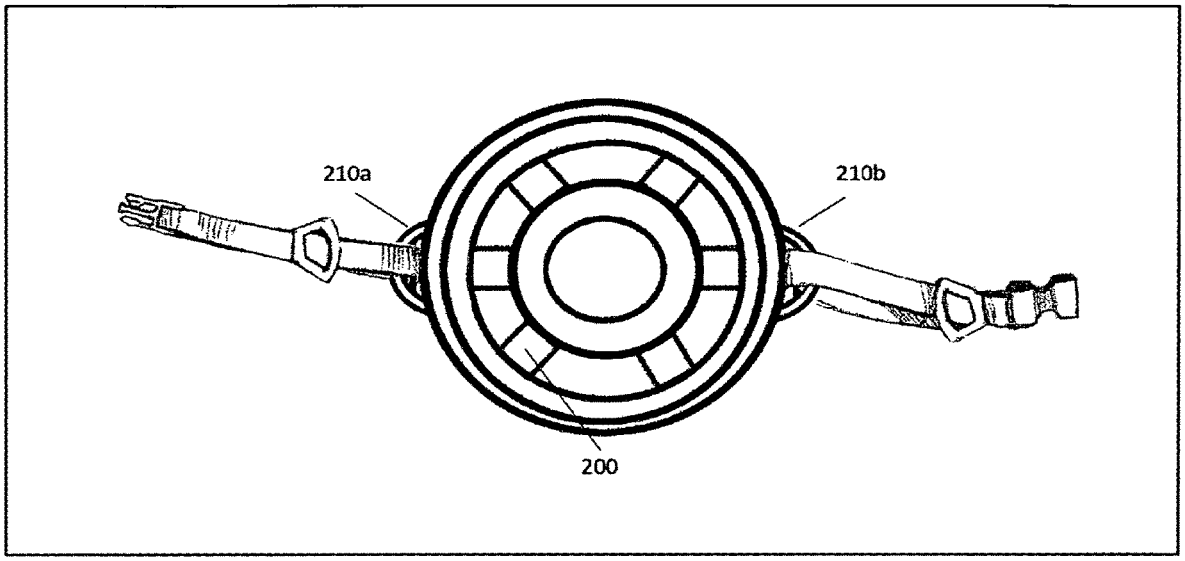
FIG. 2B shows the chassis of the wearable inflatable headpiece in a vertical plane cross-sectional view through an arm of the chassis.
Figure 2C:
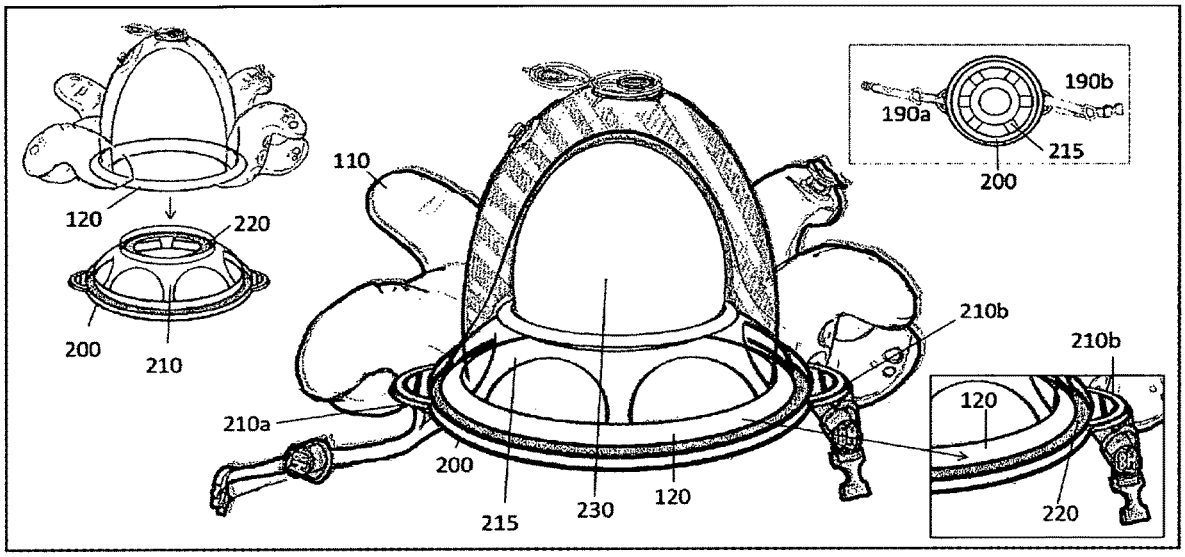
FIG. 2C shows the chassis of the wearable inflatable headpiece in a vertical plane cross-sectional view between arms of the chassis.

A chassis (200) and proximal portions of the straps (190) are shown in perspective view in FIG. 2A, in a vertical plane cross-sectional view through an arm of the chassis (200) and strap bays (210*a*) and (210*b*) in FIG. 2B, and in a vertical plane cross-sectional view between arms of the chassis (200) in FIG. 2C. The ornamental skin (110) is attached to a chassis (200) via a mating of the support ring (120) to an attachment recess (220) in the chassis (200). The chassis (200) has a base (210), a mount platform (220) which includes a mechanism mount structure (230), and six arching arms (215) which extend from the base (210) to the mount platform (220). Strap bays (210*a*) and (210*b*) protrude from diametrically-separated sides of the base (210) of the chassis (200), and the head straps (190*a*) and (190*b*) attach to the chassis (200) at strap bays (210*a*) and (210*b*).

Figure 3A:
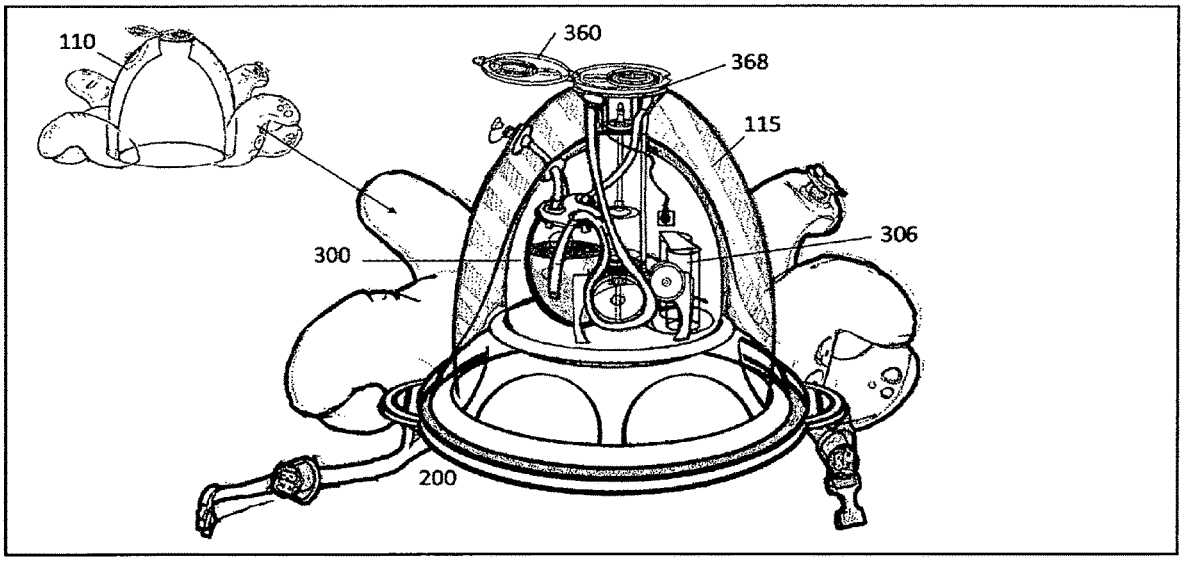
FIG. 3A is a perspective cut-away view of the inflatable headpiece with the components of the bubble blowing mechanism exposed.

As is shown in the cut-away view of FIG. 3A, mounted on the chassis (200) and seatable within the inside cavity (115) of the ornamental skin (110) is a bubble blowing mechanism (300) designed for easy, intuitive operation for the hands-free blowing of soap bubbles. Hands-free blowing of soap bubbles allows the user to be simultaneously playing, cheering, dancing, running, singing, eating or drinking.

Figure 3B:
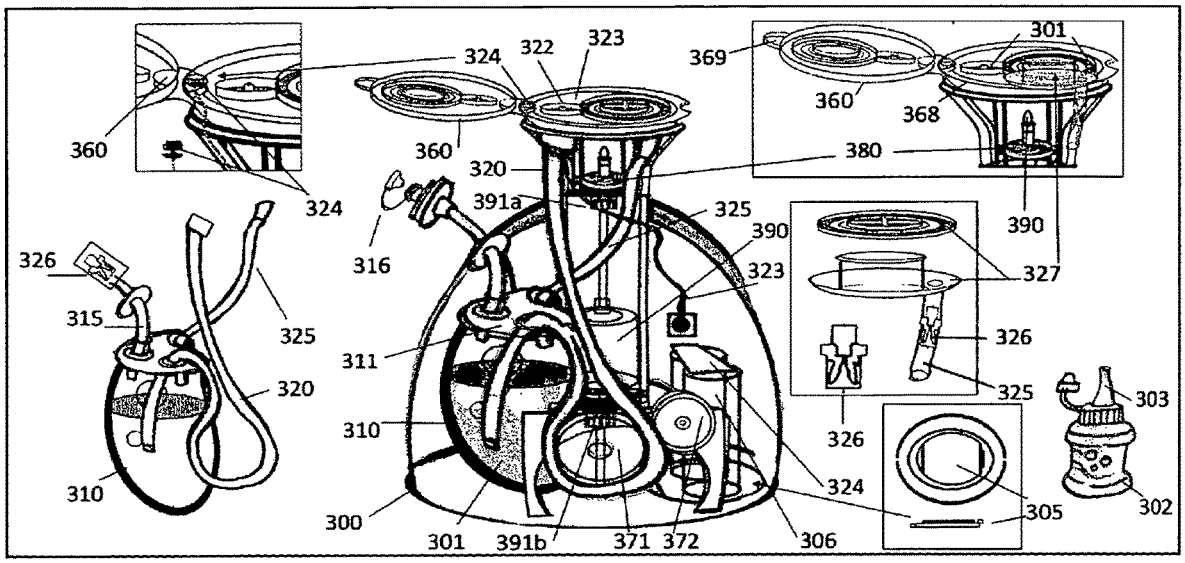
FIG. 3B is an isolated view showing the solution reservoir, refill tube, foaming bubble tube, and catch and return PVC tube of the bubble blowing mechanism.
Figure 3C:
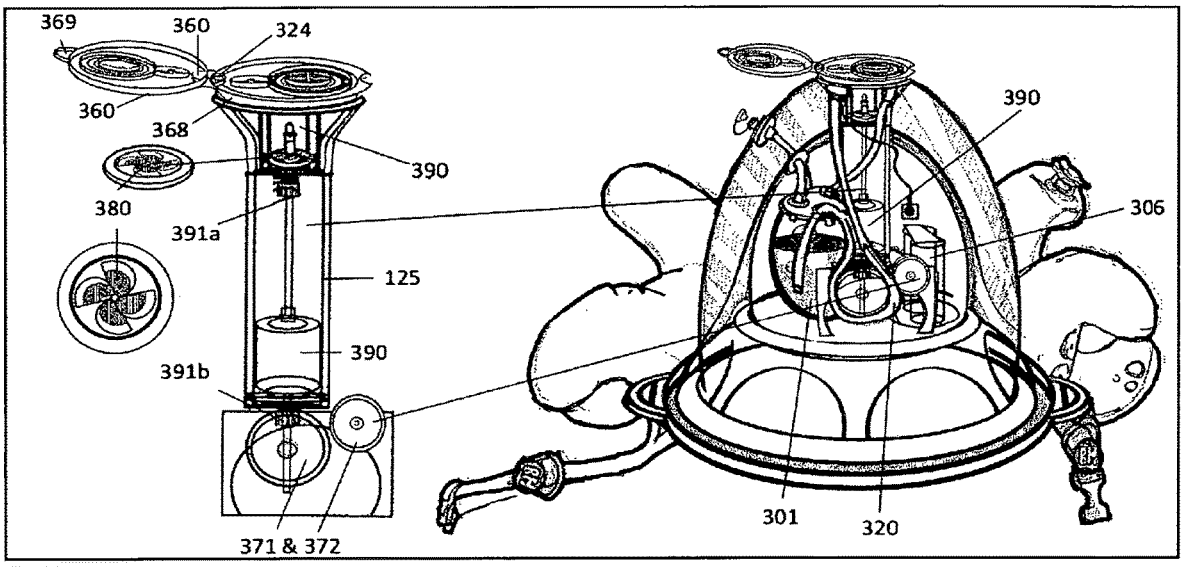
FIG. 3C is an isolated view showing the motor and gear layout of the bubble blowing mechanism.
Figure 3D:
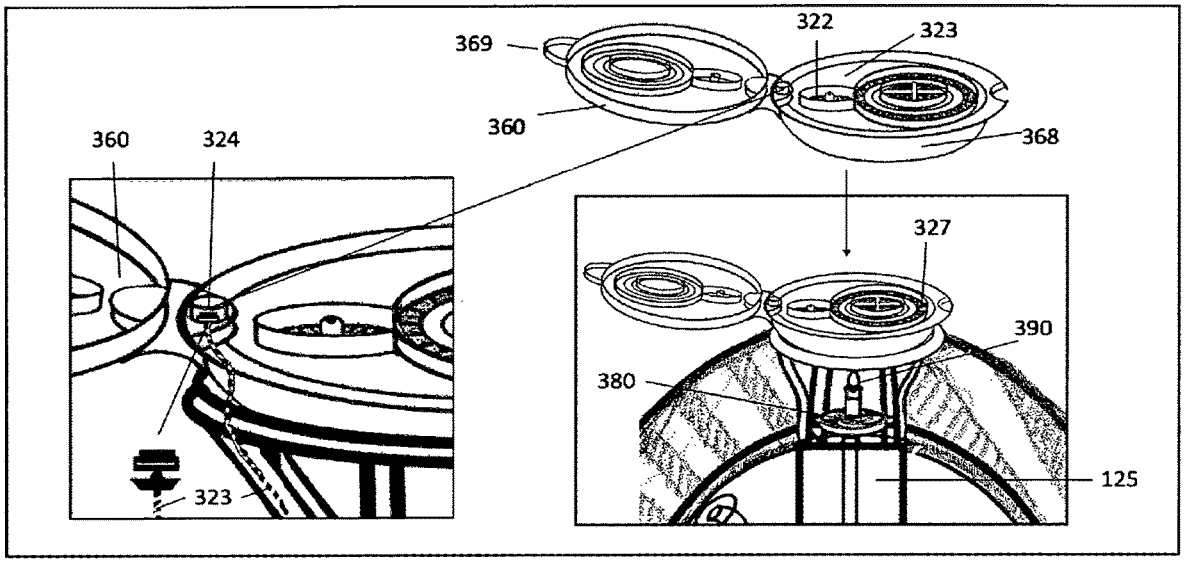
FIG. 3D is an isolated view to the pop top in an open configuration.

As is shown in FIG. 3A and the isolated view of FIGS. 3B, 3C, and 3D, the bubble blowing mechanism (300) includes a bubble solution reservoir (310) which has a reservoir lid (311), and through the lid (311) pass a refill tube (315), a foaming bubble tube (320) and a catch and return tube (325). The bubble solution reservoir (310) holds bubble solution (301), which may for instance simply be dish soap and water. The refill tube (315), foaming bubble tube (320) and catch and return tube (325) are preferably made of PVC. Within both the refill tube (315) and the catch and return tube (325) is a one-way duck bill valve (326). The catch and return tube (325) is connected to a catch and return basin (327) designed to catch excess, spilled or leaked bubble solution (301) and return it to the bubble solution reservoir (310). Both one-way duck bill valves (326) make spillage minimal even when the apparatus (100) is turned upside down. The end of the foaming bubble tube (320) distal from the bubble solution reservoir (310) is connected to an exit aperture (322) which is adjacent to the bubble exit platform (323). An air stream created by a fan (380) exits the apparatus (100) via bubble exit platform (323). At the perimeter of the exit aperture (322) is a catch and return basin (327). Rotation of a gear (391*b*) and two drive wheels (371) and (372) forces bubble solution (301) from the bubble solution reservoir (310) to the exit aperture (322) and bubble exit platform (323) at the bottom of the pop top (360). The bubble exit platform (323) is ribbed to increase surface area so as to increase the amount of bubble solution (301) which may be retained on the bubble exit platform (323). The motor (390) is a 9 volt direct current motor which interfaces with two gears (391*a*) and 391*b*), and two plastic wheels (371) and (372). The motor (390) and one gear (391*a*) power the fan (380). The other gear (391*b*) and two wheels (371) and (372) compress the PVC foaming bubble tube (320) to produce foaming of the bubble solution (301).

Operation of the bubble blowing mechanism (300) is controlled by a pressure switch (324) which functions to both control power from the batteries (306) to a fan (380) and sealing and unsealing of the exit aperture (322) via contact with a pressure switch (324) on the bubble exit platform (323). Sealing of the exit aperture (322) also prevents evaporation of the bubble solution (301) when the apparatus (100) is not in use. The pressure switch (324) is compressed when the pop top (360) is closed. The pop top (360) is easily opened by upwards pressure applied to a thumb tab (369) on the top portion (368) of the pop top (360). When pressure is reduced on the pressure switch (324) the pressure switch (324) is put into its on polarity, and power from the batteries (306) is directed to the fan (380) and LED (390). When the pop top (360) is closed and pressure on the pressure switch (324) is raised, the pressure switch (324) is put into its off polarity, and the batteries (306) are disconnected from the fan (380) and LED (390).

The end of the refill tube (315) distal from the bubble solution reservoir (310) has a tethered cap (316) and is adapted to receive input of bubble solution (301) from a universal funnel (303). It is anticipated that the apparatus (100) is sold with a three ounce bottle of bubble solution (302) which has an output which has the form of the universal funnel (303). It is anticipated that the bubble reservoir (310) will have a capacity of at least one ounce of bubble solution (301) and that will provide bubble production estimated for 40 to 60 minutes before needing to be refilled.

At the bottom of the bubble blowing mechanism (300) is a battery door hatch (305) which allows access to a battery compartment (306). Wiring (323) from the pressure switch (324) to the batteries (306) passes behind the main funnel cavity (125).

The apparatus (100) may include an LED bulb (390) to illuminate the inflatable and/or bubbles stream. Use of an LED has several advantages in that LEDs are very energy efficient, offer bright directional light, and are cool. The apparatus (100) may also include a small speaker (not shown) and a sound card and may play voices, music, etc. when the electrical system is on.

The foregoing descriptions of specific embodiments of the present invention is presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable those skilled in the art to best utilize the invention and various embodiments with various modifications as are suited to the particular use contemplated. Many other variations are possible. For example: the inflatable ornamental surface may take other forms; the chassis may have a form other than what is described; the ornamental surface may or may not be permanently bonded to the chassis; the ornamental skin may not be inflatable; the bubble blowing mechanism may not be automated; the device may include a sound card and speaker to play music, comical speech, and so on; the chassis may have more or less than six arms; etc. Furthermore, the description of the physical principles underlying the operation and performance of the present invention are also presented for purposes of illustration and description, and are not intended to be exhaustive or limiting. It should be understood that these descriptions include many approximations, simplifications and assumptions to present the basic concepts and effects which influence the operation and performance may have been neglected for ease of presentation.

Accordingly, it is intended that the scope of the invention should be determined not by the embodiments illustrated or the physical analyses motivating the illustrated embodiments, but rather by the appended Claims and their legal equivalents.

What is claimed is:

1. A wearable amusement apparatus comprising:

an automatic bubble blowing apparatus including a power source, a surfactant solution reservoir containing a surfactant, a bubble tube for transporting said surfactant to a bubble exit platform, a fan for creating an air stream through said surfactant on said bubble exit platform; and a return tube capable of returning excess surfactant from said bubble exit platform to said surfactant solution reservoir;

a chassis adapted for being worn on the head of a wearer, said chassis seating said automatic bubble blowing apparatus;

straps for attachment of said chassis of the head of said wearer; and an ornamental inflatable skin mounted on said chassis, and a pop top wherein said pop top has an open position and a closed position; wherein in said closed position a pressure switch is compressed and said fan is not powered by said power source; and when said pop top is in said open position said fan is powered by said power source.

2. The amusement apparatus of claim 1 wherein said ornamental skin has an interior bladder.

3. The amusement apparatus of claim 2 wherein said ornamental skin provides a festive appearance to the amusement apparatus.

4. The amusement apparatus of claim 1 wherein said straps are of adjustable length.

5. The amusement apparatus of claim 1 wherein said film creation mechanism repeatedly creates said surfactant film across said exit aperture.

6. The amusement apparatus of claim 1 wherein said automatic bubble blowing apparatus further includes a pop top cover for said bubble exit aperature, when said cover has sealed said exit aperature greater pressure is applied to a pressure sensitive switch and when said cover has unsealed said exit aperature less pressure is applied to said pressure sensitive switch, and when less pressure is applied to said pressure sensitive switch then power from said power source powers said fan to create said air stream.

7. The amusement apparatus of claim 1 further comprising drive wheels engaged with said bubble tube to compress said bubble tube.

8. A wearable headpiece comprising:

a chassis;

an inflatable skin attached to said chassis;

a bubble blowing mechanism wherein said bubble blowing mechanism comprises:

a power source;

a surfactant solution reservoir containing a surfactant;

a bubble exit platform;

a bubble tube for transporting said surfactant from said surfactant solution reservoir to said a bubble exit platform;

a fan for creating an air stream through said surfactant on said bubble exit platform;

a return tube capable of returning excess surfactant from said bubble exit platform to said surfactant solution reservoir;

a pressure switch between said power source and said fan; and a pop top wherein when said pop top is closed said fan is not powered by said power source; and when said pop top is in open said fan is powered by said power source.

* * * * *